US006749935B2

(12) United States Patent
Ishimura

(10) Patent No.: US 6,749,935 B2
(45) Date of Patent: Jun. 15, 2004

(54) TEMPERATURE-SENSITIVE COLOR-CHANGEABLE COMPOSITE FIBER

(75) Inventor: Naoya Ishimura, Oobu (JP)

(73) Assignee: The Pilot Ink Co., Ltd., Aichi-Ken (JP)

( * ) Notice: Subject to any disclaimer, the term of this patent is extended or adjusted under 35 U.S.C. 154(b) by 0 days.

(21) Appl. No.: 10/300,564

(22) Filed: Nov. 21, 2002

(65) Prior Publication Data

US 2003/0096112 A1 May 22, 2003

(30) Foreign Application Priority Data

Nov. 22, 2001 (JP) ..... 2001-357911
Apr. 24, 2002 (JP) ..... 2002-121720

(51) Int. Cl.[7] ..... D01F 8/00
(52) U.S. Cl. ..... 428/370; 428/373; 428/374
(58) Field of Search ..... 428/370, 373, 428/374

(56) References Cited

U.S. PATENT DOCUMENTS

| | | | | |
|---|---|---|---|---|
| 4,028,118 | A | 6/1977 | Nakasuji et al. | 106/21 |
| 4,720,301 | A | 1/1988 | Kito et al. | 106/21 |
| 4,732,810 | A | 3/1988 | Kito et al. | 428/402.2 |
| 5,011,445 | A | 4/1991 | Nakasuji et al. | 446/14 |
| 5,079,049 | A | 1/1992 | Kito et al. | 428/24 |
| 5,085,607 | A | 2/1992 | Shibahashi et al. | 446/14 |
| 5,153,066 | A | 10/1992 | Tanaka et al. | 428/373 |
| 5,219,625 | A | 6/1993 | Matsunami et al. | 428/30 |
| 5,316,513 | A | 5/1994 | Nakagawa et al. | 446/14 |
| 5,352,649 | A | 10/1994 | Shibahashi et al. | 503/207 |
| 5,376,772 | A | 12/1994 | Nakagawa et al. | 219/227 |
| 5,490,956 | A | 2/1996 | Kito et al. | 252/583 |
| 5,502,967 | A | 4/1996 | Nakagawa et al. | 62/3.3 |
| 5,507,049 | A | 4/1996 | Lane | 5/484 |
| 5,558,699 | A | 9/1996 | Nakashima et al. | 106/21 |
| 5,558,700 | A | 9/1996 | Shibahashi et al. | 106/21 A |
| 5,585,425 | A | 12/1996 | Kito et al. | 524/324 |
| 5,688,592 | A | 11/1997 | Shibahashi et al. | 428/323 |
| 5,721,059 | A | 2/1998 | Kito et al. | 428/522 |
| 5,873,932 | A | 2/1999 | Fujita et al. | 106/31.18 |
| 5,879,438 | A | 3/1999 | Fujita et al. | 106/31.18 |
| 5,879,443 | A | 3/1999 | Senga et al. | 106/498 |
| 5,919,404 | A | 7/1999 | Fujita et al. | 252/583 |
| 6,048,387 | A | 4/2000 | Shibahashi et al. | 106/31.21 |
| 6,159,598 | A | 12/2000 | Ishimura | 428/370 |

FOREIGN PATENT DOCUMENTS

| | | |
|---|---|---|
| EP | 0 410 415 A2 | 1/1991 |
| EP | 1 010 784 A1 | 6/2000 |
| JP | 03076815 | 2/1991 |
| JP | 10204725 | 4/1998 |

*Primary Examiner*—Newton Edwards
(74) *Attorney, Agent, or Firm*—Fitzpatrick, Cella, Harper & Scinto

(57) ABSTRACT

A temperature-sensitive color-changeable composite fiber comprising a phase-(A) thermochromic resin phase formed of a polyolefin resin in which a thermochromic material and an adhesive resin having a molecular weight of 200 to 10,000 or a copolymer resin of an olefin with a unit monomer capable of forming a polymer having a solubility parameter (SP value) of 9.0 or more have been dispersed or dissolved, and a phase-(B) resin phase selected from nylon 12, a copolymer nylon, polyhexamethylene terephthalate and a saturated aliphatic polyester; the phase-(A) and the phase-(B) being joined to each other. This fiber can satisfy the glossiness and touch of fibers, and color changes caused by temperature changes can clearly be sighted thereon. It also can enhance commercial value of various fiber materials and that of wigs for doles and so form, making use of such a fiber.

6 Claims, No Drawings

TEMPERATURE-SENSITIVE COLOR-CHANGEABLE COMPOSITE FIBER

This application claims the benefit of Japanese Patent Applications No. 2001-357911 and No. 2002-121720, which are hereby incorporated by reference.

BACKGROUND OF THE INVENTION

1 Field of the Invention

This invention relates to a temperature-sensitive color-changeable composite fiber. More particularly it relates to a temperature-sensitive color-changeable composite fiber having superior metachromatism.

2. Related Background Art

As conventionally available resins used in cores and sheaths of composite fibers, combination of resins having like structures are used. Such resins may include polyolefin resins, as having superior core-sheath interface joining properties and being capable of providing fibers free of any possibility of separation. However, composite fibers making use of such polyolefin resins have had so insufficient surface glossiness and touch as to have a poor commercial value.

A temperature-sensitive color-changeable composite fiber is also disclosed which is made up of a thermochromic resin phase formed of a polyolefin resin containing a thermochromic material and a protective resin phase comprised of a polyester resin or a polyamide resin (U.S. Pat. No. 5,153,066).

In the above proposal, since the polyolefin resin or polyamide resin is used to form the protective resin phase, the fiber has a good glossiness and can provide a smooth touch, but has a disadvantage that color changes of the thermochromic resin phase which are caused by temperature changes may come not clearly sighted. This is due to a poor resin-to-resin adherence of the thermochromic resin phase and the protective resin phase, which causes a phenomenon of separation at the interfaces between these phases, so that the color changes of the thermochromic resin phase which are to be sighted through the protective resin phase may come not sighted because of the scattering of light caused by any gaps produced as a result of separation.

SUMMARY OF THE INVENTION

The present invention was made in order to eliminate such difficulties the conventional temperature-sensitive color-changeable composite fiber has had. More specifically, an object of the present invention is to provide a temperature-sensitive color-changeable composite fiber which can satisfy the glossiness and touch of fibers and in which color changes caused by temperature changes can clearly be sighted.

To achieve the above object, the present invention provides as a requirement a temperature-sensitive color-changeable composite fiber comprising:

- a phase-(A) thermochromic resin phase formed of a polyolefin resin in which a thermochromic material and an adhesive resin having a molecular weight of 200 to 10,000 or a copolymer resin of an olefin with a unit monomer capable of forming a polymer having a solubility parameter (SP value) of 9.0 or more have been dispersed or dissolved; and
- a phase-(B) resin phase selected from nylon 12, a copolymer nylon, polyhexamethylene terephthalate and a saturated aliphatic polyester;
- the phase-(A) and the phase-(B) being joined to each other.

As further requirements, the adhesive resin may be at least one resin selected from a petroleum resin, a polyterpene resin, a polyisobutylene resin and an ionomer resin; the petroleum resin may be an aliphatic petroleum resin, an aromatic petroleum resin, an aliphatic-aromatic copolymer petroleum resin, a dicyclopentadiene resin, or a hydrogenated product of any of these; the unit monomer may be selected from maleic anhydride, vinyl alcohol, acrylonitrile, an acrylate and a methacrylate; the adhesive resin or the copolymer resin may be contained in the phase-(A) thermochromic resin phase in an amount of from 1% by weight to 30% by weight; the polyolefin resin may be a resin selected from a propylene resin, an ethylene-propylene copolymer resin and a mixture of an ethylene resin and a propylene resin; the polyamide resin may be contained in an amount of from 0.1% by weight to 30% by weight in the resin contained in the phase-(A) thermochromic resin phase; and the temperature-sensitive color-changeable composite fiber may be a core-sheath composite fiber comprising the phase-(A) thermochromic resin phase as a core and the phase-(B) resin phase as a sheath.

DESCRIPTION OF THE PREFERRED EMBODIMENTS

The temperature-sensitive color-changeable composite fiber of the present invention consists basically of a phase-(A) thermochromic resin phase and a phase-(B) resin phase. The phase-(A) thermochromic resin phase is formed of a polyolefin resin in which a thermochromic material and an adhesive resin having a molecular weight of 200 to 10,000 or a copolymer resin of an olefin with a unit monomer capable of forming a polymer having a solubility parameter (SP value) of 9.0 or more have been dispersed or dissolved. The phase-(B) resin phase is selected from 12-nylon, a copolymer nylon, hexamethylene terephthalate and a saturated aliphatic polyester. The phase-(A) and the phase-(B) are joined to each other.

In the foregoing, the polyolefin resin which forms the phase-(A) thermochromic resin phase may be exemplified by a polypropylene homopolymer, a polyethylene-polypropylene random copolymer, a polyethylene-polypropylene block copolymer, and a mixture of polyethylene and polypropylene. In particular, the polyethylene-polypropylene random copolymer may preferably be used, as having flexibility and an appropriate tensile strength which are required as fibers and also having a superior transparency.

As the thermochromic material contained in the phase-(A) thermochromic resin phase, a reversible thermochromic composition may preferably be used which contains three components which are an electron-donating color-developing organic compound, an electron-accepting compound and an organic compound medium capable of causing the color-developing reaction of these compounds to take place reversibly. It may specifically include reversible thermochromic compositions disclosed in U.S. Pat. No. 4,028,118 and No. 4,732,810.

The above composition changes in color at about a given temperature (color-changing point) making a border, and in the normal temperature region can only exist in any one specific state of both states before and after their color change. More specifically, these are of a type that shows what is called a small hysteresis width ($\Delta H$) on temperature/color density due to changes in temperature to cause metachromatism, in which the other state is maintained so long as the heat or cold that is required for them to come into that state is applied, but returns to the state shown in the normal temperature region once the heat or cold becomes not applied.

Also effective is one disclosed in U.S. Pat. No. 4,720,301, owned by the present assignee, which is a thermochromic color memorizable composition that shows great hysteresis characteristics to cause metachromatism, i.e., a metachromatic material of a type capable of changing in color following courses which are greatly different in shape of curves formed by plotting changes in coloring density due to changes in temperature, between a case where the temperature is raised from the side of a temperature lower than a color-changing temperature region and a case where inversely the temperature is dropped from the side of a temperature higher than the color-changing temperature region, and having a characteristic feature of capable of memorizing a state changed at a low-temperature side color-changing point or below or at a high-temperature side color-changing point, in the normal temperature region between the low-temperature side color-changing point and the high-temperature side color-changing point.

Also usable is a reversible thermochromic composition capable of developing a color upon heating, which uses an alkoxyphenol as the electron-accepting compound.

The above reversible thermochromic composition may be effective even when used as it is, but may preferably be used in the state it is enclosed in microcapsules (a microcapsule pigment). This is because such a reversible thermochromic composition can be kept to have the same composition under various use conditions and can have the same operation and effect.

The thermochromic material may be formed into such microcapsules by conventionally known methods such as interfacial polymerization, in situ polymerization, cure-in-liquid coating, phase separation from aqueous solution, phase separation from organic solvent, melt-diffusion cooling, air-suspension coating and spray drying, any of which may appropriately be selected according to uses. Also, when put into practical use, the surfaces of the microcapsules may be endowed with durability according to purposes by further forming secondary resin coatings thereon, or their surface properties may be modified.

The microcapsule pigment may have a particle diameter of from 0.5 to 30 $\mu$m, and preferably from 0.5 to 20 $\mu$m, as being effective in respect of color-developing performance and durability.

The reversible thermochromic composition may be added to the resin contained in the phase-(A) thermochromic resin phase, in an amount ranging from 0.1% by weight to 30% by weight, and preferably from 1% by weight to 10% by weight. Its addition in an amount of less than 0.1% by weight can not ensure any metachromatic performance and color density preferable as the composite fiber, making it impossible to satisfy any metachromatic function. Also, its addition in an amount of more than 30% by weight is not practical because any remarkable improvement in metachromatism density may no longer be seen and the fluidity may greatly lower at the time of fiber making to cause an extreme lowering of spinning performance.

The adhesive resin having a molecular weight of 200 to 10,000 or the copolymer resin of an olefin with a unit monomer capable of forming a polymer having a solubility parameter (SP value) of 9.0 or more, which is contained in the phase-(A) thermochromic resin phase, is a join improver which improves the joining between the polyolefin resin used in the phase-(A) thermochromic resin phase and the resin used in the phase-(B) resin phase. Such improvement in the joining between them enables the color changes of the phase-(A) thermochromic resin phase to be clearly sighted even through the phase-(B) resin phase.

The solubility parameter (SP value) is defined as expressed by the following equation.

$$\delta^2=E/V$$

$\delta$: Solubility parameter [$\sqrt{(cal/cm^3)}$].
E: Cohesive energy (cal/mol).
V: Molar volume ($cm^3$/mol).

In the above copolymer resin, the unit monomer capable of forming a polymer having a solubility parameter (SP value) of 9.0 or more is used as the monomer with which the olefin is to be copolymerized, because the polymer used in the phase-(B) resin phase has an SP value of 9.0 or more. This ensures good joining between the phase-(A) thermochromic resin phase and the phase-(B) resin phase.

As the olefin constituting the copolymer resin, usable are those which commonly form polyolefins, such as ethylene and propylene. Also, as the unit monomer capable of forming a polymer having a solubility parameter (SP value) of 9.0 or more, usable are maleic anhydride, vinyl alcohol, acrylonitrile, an acrylate and a methacrylate.

As the adhesive resin, a resin selected from a petroleum resin, a polyterpene resin, a polyisobutylene resin and an ionomer resin may preferably be used.

As the petroleum resin, an aliphatic petroleum resin, an aromatic petroleum resin, an aliphatic-aromatic copolymer petroleum resin, a dicyclopentadiene resin, or a hydrogenated product of any of these may preferably be used.

In the join improver, a hydrogenated product of dicyclopentadiene resin may preferably be used as the adhesive resin, and a polyolefin resin-maleic anhydride copolymer resin as the copolymer resin.

The adhesive resin or the copolymer resin of an olefin with a unit monomer capable of forming a polymer having a solubility parameter (SP value) of 9.0 or more may also preferably be contained in an amount of from 1% by weight to 30% by weight in the resin contained in the phase-(A) thermochromic resin phase. If it is less than 1% by weight, any desired joining may be achieved with difficulty. If it is more than 30% by weight, difficulties which concern strength or cause whitening on flexing tend to be brought about.

In the phase-(A) thermochromic resin phase, a polyamide resin may further be incorporated in an amount of from 0.1% by weight to 30% by weight in the resin contained in the phase-(A) thermochromic resin phase.

This is because the incorporation of the polyamide resin brings about the effect that any aftercolor caused by reversible color development of the reversible thermochromic composition, ascribable to the polyolefin resin, can be prevented by neutralizing it by the basic action the polyamide resin has.

As a fiber-forming thermoplastic polymer which forms the phase-(B) resin phase, a specific polyamide resin or a polyester resin may be used, from among crystalline polymers which satisfy stringiness and fiber performance.

As the specific polyamide resin, it may be selected from nylon 12 and a copolymer nylon such as nylon 6, 12. As the polyester resin, it may be selected from polyhexamethylene terephthalate and a saturated aliphatic polyester.

The nylon 12 can be processed at a lower temperature than other nylon resins and the copolymer nylon has superior transparency, and hence these may preferably be used.

Herein, the composite fiber of the present invention may be at least one in which the phase-(A) thermochromic resin phase and the phase-(B) resin phase are joined into an integral form. Without limitation to the core-sheath type, it may have any form such as a laminate type or an islands-in-sea type.

In the core-sheath type, the whole periphery of the phase-(A) thermochromic resin phase is covered with the phase-(B) resin phase, and hence the composite fiber can satisfy durabilities such as light-fastness, wash-fastness and rub-fastness. At the same time, the phase-(B) resin phase is formed by a fiber-forming thermoplastic polymer rich in transparency and glossiness, and hence a temperature-sensitive color-changeable composite fiber rich in glossiness can be provided in which sharp color changes of the phase-(A) thermochromic resin phase can be sighted.

As the temperature-sensitive color-changeable composite fiber, one having an outer diameter of from 10 μm to 300 μm may favorably be used, and it is effective to use one having an outer diameter ranging preferably from 50 μm to 150 μm, and more preferably from 60 μm to 100 μm.

The composite fiber of the present invention may at least have the fiber form in which the phase-(A) thermochromic resin phase and the phase-(B) resin phase are joined into an integral form, and is by no means limited to the form of a core-sheath type shown in the following Examples.

EXAMPLES

Examples of the temperature-sensitive color-changeable composite fiber are given below. In the following Examples and Comparative Examples, "part(s)" refers to "part(s) by weight".

Example 1

5 parts of a reversible thermochromic microcapsule pigment reversibly color-changeable in blue at 30° C. and below and to come colorless at 32° C. and above, 1 part of a dispersant, 90 parts of polypropylene-ethylene copolymer and 4 parts of polypropylene-maleic anhydride copolymer resin were melt-kneaded at 180° C. by means of an extruder to obtain reversible thermochromic pellets.

The reversible thermochromic pellets thus obtained and nylon 12 resin were fed into a core-forming extruder and a sheath-forming extruder, respectively. Keeping these at a melt temperature of 200° C., these were spinned through ejection orifices with 20 holes by means of a composite-fiber spinning apparatus in a core-sheath volume ratio of 60/40 to obtain temperature-sensitive color-changeable composite fiber multifilaments consisting of 20 single yarns of 90 μm in thickness.

The above temperature-sensitive color-changeable composite fiber had a like coloring density compared with a temperature-sensitive color-changeable composite fiber produced in the same manner as in Example 1 except that the sheath-part nylon 12 resin was changed to polypropylene-ethylene copolymer. It also had superior glossiness and touch which were attributable to the sheath-part nylon resin, showed a reversible thermochromic performance that it turned blue in the normal-temperature region (30° C. and below) and changed to come almost colorless at about 32° C. and above, and was able to exhibit its thermochromic function lastingly as to performance with time, too.

The multifilaments were also set in the head of a dole by a conventional method to obtain a dole toy or toy figure, where the filaments changed in color in a good coloring density and had superior glossiness also after their setting, and were found suitable for hairs of doles and animal toys, having external appearance, touch and durability required as artificial hair and being able to exhibit their thermochromic function lastingly.

Example 2

5 parts of a thermochromic microcapsule pigment enclosing a reversible thermochromic composition reversibly color-changeable in blue at 30° C. and below and to come colorless at 32° C. and above, 1 part of a dispersant, 50 parts of polypropylene homopolymer, 40 parts of low-density polyethylene and 4 parts of a hydrogenated product of dicyclopentadiene resin were melt-kneaded at 200° C. by means of an extruder to obtain reversible thermochromic pellets.

The reversible thermochromic pellets thus obtained and copolymer resin nylon 6,12 were fed into a core-forming extruder and a sheath-forming extruder, respectively. Keeping these at a melt temperature of 200° C., these were spinned through election orifices with 18 holes by means of a composite-fiber spinning apparatus in a core-sheath volume ratio of 50/50 to obtain temperature-sensitive color-changeable composite fiber multifilaments consisting of 18 single yarns of 100 μm in thickness.

The above temperature-sensitive color-changeable composite fiber had a like coloring density compared with a temperature-sensitive color-changeable composite fiber produced in the same manner as in Example 2 except that the sheath-part copolymer resin nylon 6, 12 was changed to polypropylene homopolymer. It also had superior glossiness and touch which were attributable to the sheath-part nylon resin, showed a reversible thermochromic performance that it turned blue in the normal-temperature region (30° C. and below) and changed to come almost colorless at about 32° C. and above, and was able to exhibit its thermochromic function lastingly as to performance with time, too.

The multifilaments were woven to make up a wig, where the filaments were found suitable for wigs, having external appearance, appropriate touch and durability required as artificial hair, showing a reversible thermochromic performance that it turned blue in the normal-temperature region (30° C. and below) and changed to come almost colorless at about 32° C. and above, and being able to exhibit its thermochromic function as to performance with time, too.

Example 3

5 parts of a reversible thermochromic microcapsule pigment capable of turning pink at 17° C. and below and memorizing and maintaining this state at a temperature below 30° C., and also turning colorless upon heating to 30° C. and above and memorizing and maintaining this state at a temperature above 17° C., 1 part of a dispersant, 85 parts of polypropylene-ethylene copolymer and 9 parts of ethylene-vinyl alcohol copolymer resin were melt-kneaded at 190° C. by means of an extruder to obtain reversible thermochromic pellets.

The reversible thermochromic pellets thus obtained and polyhexamethylene terephthalate resin were fed into a core-forming extruder and a sheath-forming extruder, respectively. Keeping these at a melt temperature of 190° C., these were spinned through ejection orifices with 20 holes by means of a composite-fiber spinning apparatus in a core-sheath volume ratio of 60/40 to obtain temperature-sensitive color-changeable composite fiber multifilaments consisting of 20 single yarns of 90 μm in thickness.

The above temperature-sensitive color-changeable composite fiber had like coloring density and glossiness compared with a temperature-sensitive color-changeable composite fiber produced in the same manner as in Example 3 except that the sheath-part polyhexamethylene terephthalate resin was changed to polypropylene-ethylene copolymer. It also had a superior touch, showed a reversible thermochromic performance that it turned pink at 17° C. and below at the time of cooling and changed to come colorless at about 30° C. and above at the time of heating, and was able to exhibit its thermochromic function lastingly as to performance with time, too.

Example 4

5 parts of a reversible thermochromic microcapsule pigment reversibly color-changeable in brown at 20° C. and below and to come colorless at 22° C. and above, 1 part of a dispersant, 84 parts of polypropylene homopolymer, 10 parts of a hydrogenated product of aliphatic petroleum resin and 1 part of copolymer nylon 6, 12 were melt-kneaded at 180° C. by means of an extruder to obtain reversible thermochromic pellets.

The reversible thermochromic pellets thus obtained and copolymer resin nylon 6,12 were fed into a core-forming extruder and a sheath-forming extruder, respectively. Keeping these at a melt temperature of 180° C., these were spinned through ejection orifices with 18 holes by means of a composite-fiber spinning apparatus in a core-sheath volume ratio of 50/50 to obtain temperature-sensitive color-changeable composite fiber multifilaments consisting of 18 single yarns of 100 μm in thickness.

The above temperature-sensitive color-changeable composite fiber had a like coloring density compared with a temperature-sensitive color-changeable composite fiber produced in the same manner as in Example 4 except that the sheath-part copolymer resin nylon 6, 12 was changed to polypropylene homopolymer. It also had superior glossiness and touch which were attributable to the sheath-part nylon resin, showed a reversible thermochromic performance that it turned blown at 20° C. and below and changed to come almost colorless at about 22° C. and above, and was able to exhibit its thermochromic function lastingly as to performance with time, too.

Example 5

5 parts of a thermochromic microcapsule pigment enclosing a reversible thermochromic composition reversibly color-changeable in blue at 30° C. and below and to come colorless at 32° C. and above, 1 part of a non-thermochromic pink pigment, 1 part of a dispersant, 50 parts of polypropylene homopolymer, 1 part of copolymer nylon 6, 12, 40 parts of low-density polyethylene and 4 parts of a hydrogenated product of dicyclopentadiene resin were melt-kneaded at 200° C. by means of an extruder to obtain reversible thermochromic pellets.

The reversible thermochromic pellets thus obtained and copolymer resin nylon 6, 12 were fed into a core-forming extruder and a sheath-forming extruder, respectively. Keeping these at a melt temperature of 200° C., these were spinned through ejection orifices with 18 holes by means of a composite-fiber spinning apparatus in a core-sheath volume ratio of 50/50 to obtain temperature-sensitive color-changeable composite fiber multifilaments consisting of 18 single yarns of 100 μm in thickness.

The above temperature-sensitive color-changeable composite fiber had a like coloring density compared with a temperature-sensitive color-changeable composite fiber produced in the same manner as in Example 5 except that the sheath-part copolymer resin nylon 6, 12 was changed to polypropylene homopolymer. It also had superior glossiness and touch which were attributable to the sheath-part nylon resin, showed a reversible thermochromic performance that it turned blue in the normal-temperature region (30° C. and below) and changed vivid-purple as to be pink at about 32° C. and above, and was able to exhibit its thermochromic function lastingly as to performance with time, too.

The multifilaments were woven to make up a wig, where the filaments were found suitable for wigs, having external appearance, appropriate touch and durability as artificial hair, showing a reversible thermochromic performance that it turned vivid-purple in the normal-temperature region (30° C. and below) and changed to come pink at about 32° C. and above, and being able to exhibit its thermochromic function lastingly as to performance with time, too.

Comparative Example 1

Multifilaments consisting of single yarns of 90 μm in thickness were obtained in the same manner as in Example 1 except that the polypropylene-maleic anhydride copolymer resin used therein was not mixed.

The filaments had a low coloring density, and showed a further lowering of density when worked for, e.g., setting hairs.

Comparative Example 2

Multifilaments consisting of single yarns of 100 μm in thickness were obtained in the same manner as in Example 2 except that the hydrogenated product of dicyclopentadiene resin used therein was not mixed. The filaments had a low coloring density, and showed a further lowering of density when worked for, e.g., setting hairs.

Comparative Example 3

Multifilaments consisting of single yarns of 90 μm in thickness were obtained in the same manner as in Example 3 except that the ethylene-vinyl alcohol copolymer resin used therein was not mixed. The filaments had a low coloring density, and showed a further lowering of density when worked for, e.g., setting hairs.

Comparative Example 4

Multifilaments consisting of single yarns of 100 μm in thickness were obtained in the same manner as in Example 4 except that the hydrogenated product of aliphatic petroleum resin used therein was not mixed. The filaments had a low coloring density, and showed a further lowering of density when worked for, e.g., setting hairs.

Comparative Example 5

Multifilaments consisting of single yarns of 100 μm in thickness were obtained in the same manner as in Example 5 except that the hydrogenated product of dicyclopentadiene resin used therein was not mixed. The filaments had a low coloring density, and showed a further lowering of density when worked for, e.g., setting hairs.

As described above, the present invention can provide a temperature-sensitive color-changeable composite fiber which can satisfy the glossiness and touch of fibers and in which color changes caused by temperature changes can clearly be sighted, and also which has utility as a fiber material and can enhance commercial value of clothing and that of hairs, wigs, false hairs and so forth for doles, making use of such a fiber.

What is claimed is:

1. A temperature-sensitive color-changeable composite fiber comprising:

a phase-(A) thermochromic resin phase comprising a polyolefin resin in which a thermochromic material and, dispersed or dissolved therein, from 1 to 30 wt % based on phase-(A) of (i) an adhesive resin selected from the group consisting of a petroleum resin, a polyterpene resin, a polyisobutylene resin and an ionomer resin or (ii) a copolymer resin of an olefin with a unit monomer selected from the group consisting of maleic anhydride, vinyl alcohol, acrylonitrile, an acrylate and a methacrylate, said phase-(A) further comprising 0.1 to 30 wt % thermochromic material; and a phase-(B) resin phase selected from the group consisting of nylon 12, a copolymer nylon, polyhexamethylene terephthalate and a saturated aliphatic polyester;

said phase-(A) and the phase-(B) being joined to each other.

2. The temperature-sensitive color-changeable composite fiber according to claim 1, comprising a petroleum resin selected from the group consisting of an aliphatic petroleum resin, an aromatic petroleum resin, an aliphatic-aromatic copolymer petroleum resin, a dicyclopentadiene resin, or a hydrogenated product of any of these.

3. The temperature-sensitive color-changeable composite fiber according to claim 1, wherein said polyolefin resin is selected from the group consisting of a propylene resin, an ethylene-propylene copolymer resin and a mixture of an ethylene resin and a propylene resin.

4. The temperature-sensitive color-changeable composite fiber according to any one of claims 1, 2 or 3, comprising a polyamide resin contained in an amount of from 0.1% by weight to 30% by weight in the phase-(A) thermochromic resin phase.

5. The temperature-sensitive color-changeable composite fiber according to any one of claims 1, 2 to 3, which is a core sheath composite fiber comprising the phase-(A) thermochromic resin phase as a core and the phase-(B) resin phase as a sheath.

6. The temperature sensitive color-changeable composite fiber according to claim 4, which is a core sheath composite fiber comprising the phase-(A) thermochromic resin phase as a core and the phase-(B) resin phase as a sheath.

* * * * *